US005959273A

United States Patent [19]

Chou

[11] Patent Number: 5,959,273

[45] Date of Patent: Sep. 28, 1999

[54] ELECTRIC OUTLET WITH PRESS-BUTTON SWITCH MEANS

[76] Inventor: Jonie Chou, 9F-4, No. 232, Chung Ho Road, Chung Ho City, Taipei Hsien, Taiwan

[21] Appl. No.: 08/908,521

[22] Filed: Aug. 7, 1997

[51] Int. Cl.[6] ..... H01H 9/02

[52] U.S. Cl. ..... 200/332.1; 200/330; 200/341; 200/573

[58] Field of Search ..... 200/332.1, 341, 200/331, 330, 327, 43.08, 573

[56] References Cited

U.S. PATENT DOCUMENTS 5,274,527 12/1993 Retzlaff ..... 200/43.08

5,577,601 11/1996 Chung et al. ..... 200/331

5,579,900 12/1996 Pryor et al. ..... 200/331

*Primary Examiner*—David J. Walczak

*Attorney, Agent, or Firm*—Bacon & Thomas

[57] ABSTRACT

An electric outlet including a casing having a bottom shell and a cover shell covered on the bottom shell, a plurality of socket units mounted in the casing and respectively connected to a power circuit and adapted for providing electricity to electric plugs connected thereto, a press switch having a press lever forced by spring means to cut off the power circuit, a slide fastened to the press lever and having a bevel face, a press button sliding vertically on a trace device and having a beveled downward rod disposed in contact with the bevel face of the slide and a button head extending out of the casing for operation by foot to switch on the switch.

4 Claims, 3 Drawing Sheets

ELECTRIC OUTLET WITH PRESS-BUTTON SWITCH MEANS

BACKGROUND OF THE INVENTION

The present invention relates to electric outlets, and more particularly to such an electric outlet which has a press switch controlled by foot to close/open the circuit.

Regular electric outlets are commonly equipped with an overcurrent protection circuit or fuse means, an on/off switch for power on/off control, and an indicator lamp for power on/off indication. When an electric outlet is installed in a room under a furniture for example a desk or office table, one shall have to bend the body and use the hand to switch on the on/off switch. When to switch off the electric outlet, one shall have to bend the body again and use the hand to switch off the on/off switch.

SUMMARY OF THE INVENTION

The present invention has been accomplished to provide an electric outlet which eliminates the aforesaid problem. According to the preferred embodiment of the present invention, the electric outlet comprises a casing having a bottom shell and a cover shell covered on a bottom shell, and a plurality of socket units mounted in the casing and respectively connected to a power circuit and adapted for providing electricity to electric plugs connected thereto, wherein: the cover shell of the casing has a button hole; a positioning device is mounted inside the bottom shell to support a switch, the positioning device comprising a pair of parallel base flanges, two transverse flanges bilaterally and outwardly extended from the base flanges at right angles, and two locating slots respectively defined between the base flanges and the transverse flanges; a press switch is mounted in between the two base flanges of the positioning device and connected between the socket units and the power circuit for power on/off control, the on/off switch comprising two wings respectively fastened to the locating slots of the positioning device, a press lever forced to close the circuit, and spring means adapted to impart an outward pressure to the press lever and to move the press lever to the off position; a slide is fastened to the press lever and forced to move the press lever against the spring means, causing the press lever to close the circuit, the slide having a bevel face at one side; a track device is mounted inside the bottom shell to support a press button, the track device comprising two upright base rails defining a respective vertical sliding groove therebetween, and a side rail disposed outside the upright base rails and defining a sliding slot; and a press button moved vertically on the track device to switch on/off the press switch, the press button comprising a button head projecting out of the button hole of the cover shell, an outward flange raised around the periphery of the button head and stopped below the button hole, a plurality of downward sliding rods downwardly raised from the button head and respectively movably inserted into the vertical sliding grooves and sliding slot of the track device, and a beveled downward rod having a beveled bottom edge disposed in contact with the bevel face of the slide, the beveled downward rod forcing the slide to push the press lever to the on position when the button head of the press button is depressed.

BRIEF DESCRIPTION OF THE DRAWINGS

FIG. 2 is a schematic drawing of the present invention, showing the press button depressed, the press lever pushed backwards, the switch switched on;

DETAILED DESCRIPTION OF THE PREFERRED EMBODIMENT

Figure 1:
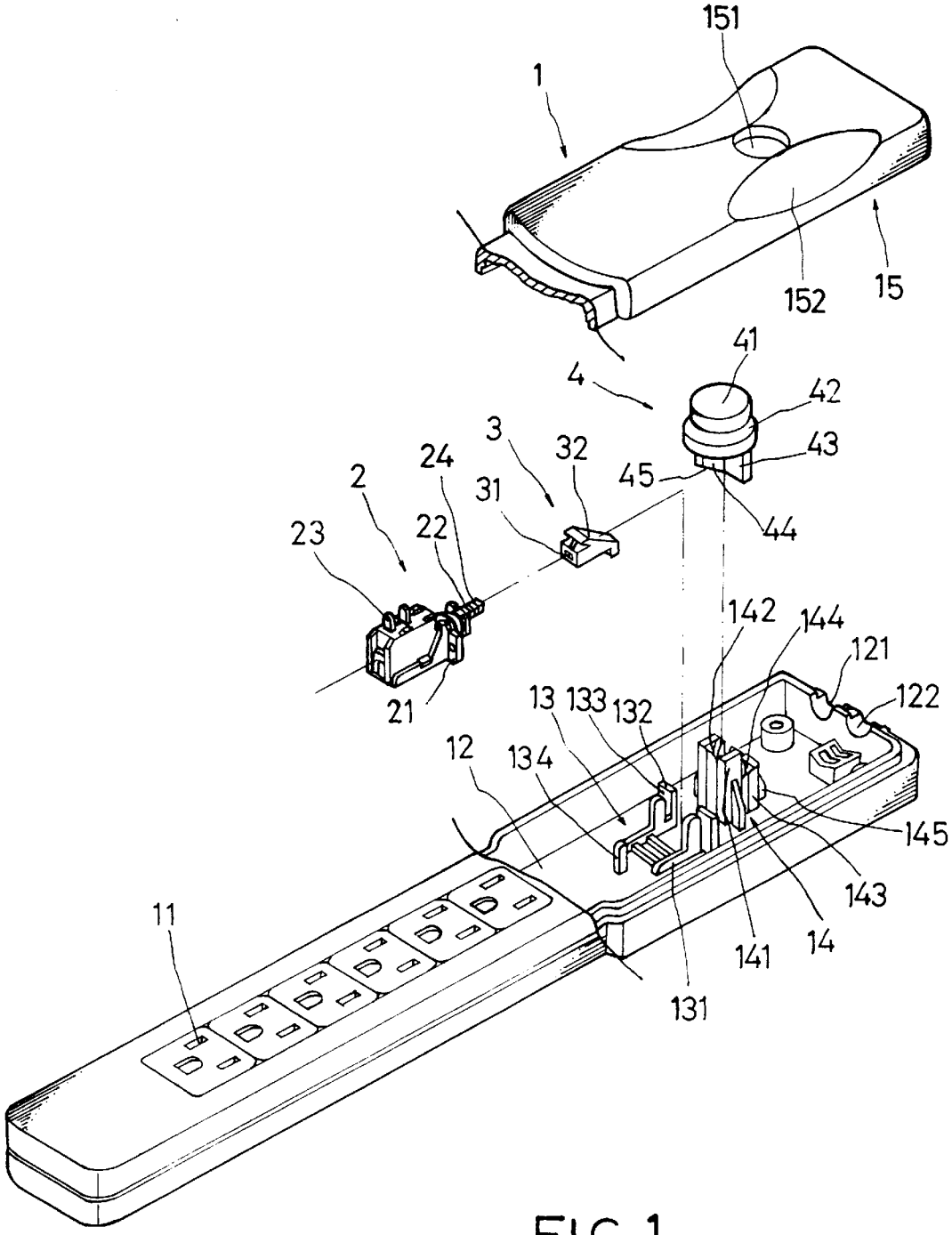
FIG. 1 is an exploded view of an electric outlet according to the present invention.

Referring to Figures from 1 to 4, an electric outlet in accordance with the present invention comprises an elongated outlet body 1 having a plurality of socket units 11 from which electricity can be obtained by electric plugs. The outlet body 1 comprises a top-open chamber 12 at one end, and a cover shell 15 covered on the top-open chamber 12. A wire hole 121 and a reset hole 122 are disposed at one end, namely the rear end of the top-open chamber 12 remote from the sets of plug insertion slots 11, and adapted for mounting an electric cable and a reset device respectively. A positioning device 13 is mounted inside the top-open chamber 12 to support a switch 2. The positioning device 13 comprises a pair of parallel base flanges 131 longitudinally raised from the bottom wall of the top-open chamber 12, two transverse flanges 132 bilaterally and outwardly extended from the base flanges 131 at right angles, two locating slots 133 respectively defined between the base flanges 131 and the transverse flanges 132, and an upright stop rod 134 raised from the bottom wall of the top-open chamber 12 in the middle in front of the base flanges 131. The switch 2 is mounted in the positioning device 13 and stopped in between the base flanges 131 by the upright stop rod 134. A track device 14 is disposed inside the top-open chamber 12 between the positioning device 13 and the rear end of the top-open chamber 12, and adapted to support a press button 4. The track device 14 comprises two upright base rails 141 raised from the bottom wall of the top-open chamber 12 and defining a respective vertical sliding groove 142 therebetween, a side rail 143 disposed outside the upright base rails 141 and defining a sliding slot 144, and a reinforcing rib 145 connected between the base rails 141 and the side rail 143.

The aforesaid switch 2 is an on/off switch mounted on the positioning device 13 between its two parallel base flanges 131 and has two wings 21 respectively positioned in the locating slots 133, a press lever 22 horizontally projecting out of the positioning device 13 toward the track device 14, a spring 24 adapted to impart an outward pressure to the press lever 22, and two electrodes 23 respectively connected to the hot line and neutral line of the electrical cable and the two opposite terminals of the circuit board (not shown) in the outlet body 1.

A slide 3 is coupled to the switch 2 and moved to switch on/off the switch 2 and has a mounting hole 31 at one end fastened to the press lever 22 of the switch 2 and a bevel face 32 at an opposite end. The bevel face 32 slopes downwardly toward the track device 14.

The aforesaid press button 4 is vertically movably supported on the track device 14 and comprises a button head 41 projecting out of a button hole 151 of the cover shell 15, an outward flange 42 raised around the periphery of the button head 41 and stopped below the button hole 151, a plurality of downward sliding rods 43; 44 downwardly raised from the button head 41 at the bottom and respectively movably inserted into the vertical sliding grooves 142 and the sliding slot 144, and a beveled downward rod 45 disposed in contact with the bevel face 32 of the slide 3. Further, the aforesaid cover shell 15 has two concave surface portions 152 at two opposite sides of its button hole 151 adapted for supporting the foot, so that the foot can be stepped on the button head 41 of the press button 4.

Figure 3:
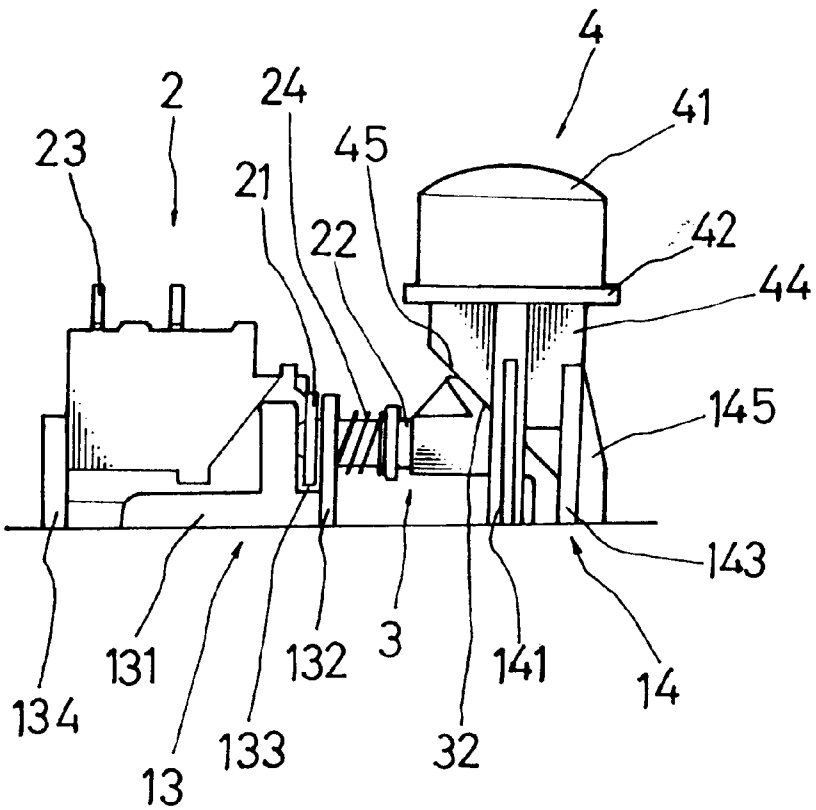
FIG. 3 is similar to FIG. 2 but showing the press button and released, the press lever extended outwards, the switch switched off.
Figure 2:
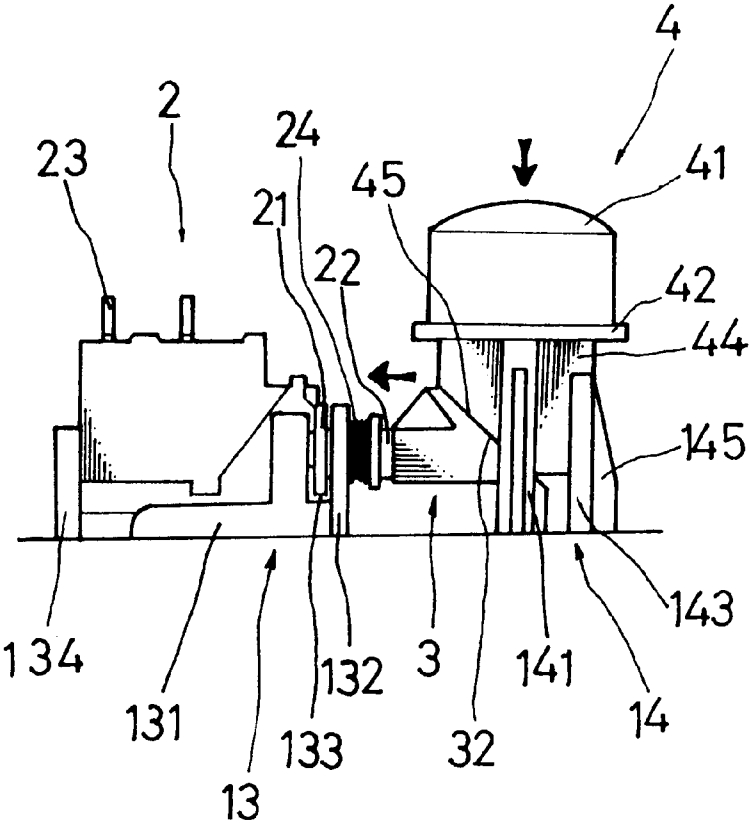
Figure 4:
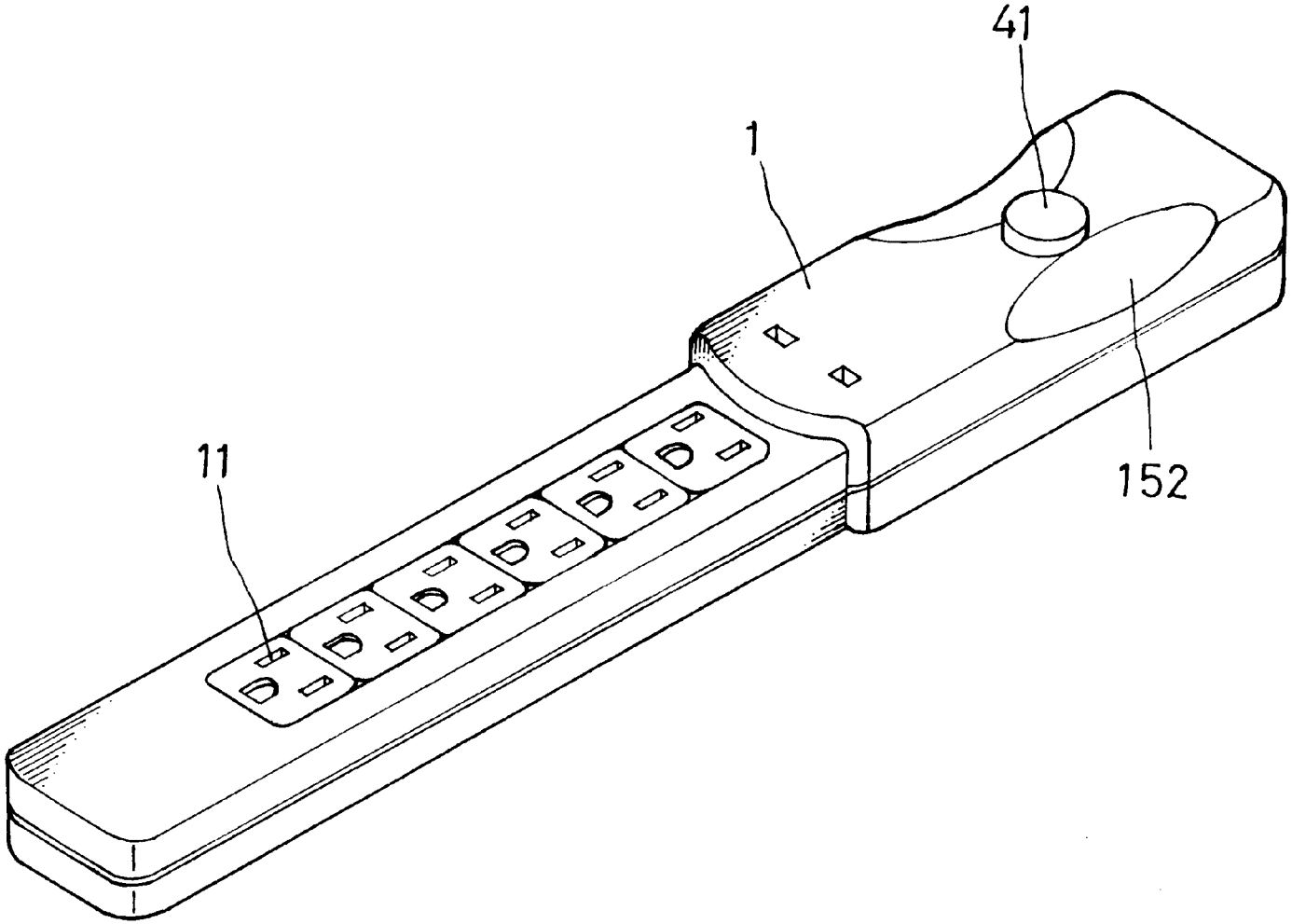
FIG. 4 is an elevational view of the electric outlet shown in FIG. 1.

Referring to FIGS. 2 and 3 again, when the user's foot is stepped on the button head 41, the beveled downward rod 45 is lowered with the press button 4 to force the slide 3 forwards, and therefore the press lever 22 is depressed to switch on the switch 2 (see FIG. 2). When the switch 2 is switched on, electricity is connected to the socket units 11. When the button head 41 of the press button 4 is pressed again and then immediately released, the spring 24 immediately pushes the press lever 22 outwards to switch off the switch 2, and at the same time the slide 3 is forced outwards to push the press button 4 upwardly back to its former position (see FIG. 3).

While only one embodiment of the present invention has been shown and described, it will be understood that various modifications and changes could be made thereunto without departing from the spirit and scope of the invention disclosed.

What the invention claimed is:

1. A electric outlet comprising a casing having a bottom shell and a cover shell on said bottom shell, and a plurality of socket units mounted in said casing and respectively connected to a power circuit and adapted for providing electricity to electric plugs connected thereto, wherein:

said cover shell of said casing has a button hole;

a positioning device is mounted inside said bottom shell to support a switch, said positioning device comprising a pair of parallel base flanges, two transverse flanges bilaterally and outwardly extended from said base flanges at right angles, and two locating slots respectively defined between said base flanges and said transverse flanges;

a press switch is mounted in between said two base flanges of said positioning device and connected between said socket units and said power circuit for power on/off control of said socket units, said press switch comprising two wings respectively fastened to the locating slots of said positioning device, a press lever depressible to close the circuit, and spring means adapted to impart an outward pressure to said press lever and to move said press lever to an off position;

a slide is fastened to said press lever and forced to move said press lever against said spring means, causing said press lever to close the circuit, said slide having a bevel face at one side;

a track device is mounted inside said bottom shell to support a press button, said track device comprising two upright base rails defining a respective vertical sliding groove therebetween, and a side rail disposed outside said upright base rails and defining a sliding slot; and a press button moved vertically on said track device, said press button comprising a button head projecting out of the button hole of said cover shell, an outward flange raised around the periphery of said button head and stopped below said button hole, a plurality of downward sliding rods downwardly raised from said button head and respectively movably inserted into the vertical sliding grooves and sliding slot of said track device, and a beveled downward rod having a beveled bottom edge disposed in contact with the bevel face of said slide, said beveled downward rod forcing said slide to push said press lever to the on position when the button head of said press button is depressed.

2. The electric outlet of claim 1, wherein said positioning device further comprises an upright stop rod disposed in front of said base flanges and adapted to stop said press switch in place.

3. The electric outlet of claim 1, wherein a reinforcing rib is connected between the base rails and side rail of said trace device to reinforce its structural strength.

4. The electric outlet of claim 1, wherein said cover shell of said casing has two concave portions at two opposite sides of said button hole adapted for supporting the user's foot.

* * * * *